United States Patent [19]

Powell

[11] 4,023,880

[45] May 17, 1977

[54] CONTACT RETENTION ASSEMBLY

[75] Inventor: Lloyd J. Powell, Newmarket, Canada

[73] Assignee: International Telephone and Telegraph Corporation, New York, N.Y.

[22] Filed: Aug. 9, 1974

[21] Appl. No.: 496,047

[52] U.S. Cl. ..... 339/59 R; 339/63 M
[51] Int. Cl.² ..... H01R 9/16
[58] Field of Search ..... 339/59, 60, 61, 62, 339/63

[56] References Cited

UNITED STATES PATENTS

| | | | |
|---|---|---|---|
| 3,101,229 | 8/1963 | Yopp | 339/59 M |
| 3,638,165 | 1/1972 | Anhalt | 339/59 R |
| 3,812,447 | 5/1974 | Eifler | 339/59 R |
| 3,845,452 | 10/1974 | Eifler | 339/59 R |

FOREIGN PATENTS OR APPLICATIONS

| | | | |
|---|---|---|---|
| 1,073,048 | 6/1967 | United Kingdom | 339/62 |

*Primary Examiner*—Roy Lake
*Assistant Examiner*—Mark S. Bicks
*Attorney, Agent, or Firm*—Thomas L. Peterson

[57] ABSTRACT

A contact retention assembly for an electrical connector comprising a retention disc having a passage therethrough receiving an electrical contact. Radially resilient retention fingers integral with the disc have inwardly extending ribs which engage within an annular groove in the contact to retain the contact in the passage. A relatively rigid collar is mounted over the retention fingers in front of the disc to restrain the fingers against outward movement thereby locking the contact in place. The collar may be slidably removed to allow removal of the contact from the contact passage from the rear.

1 Claim, 12 Drawing Figures

FIG.6.
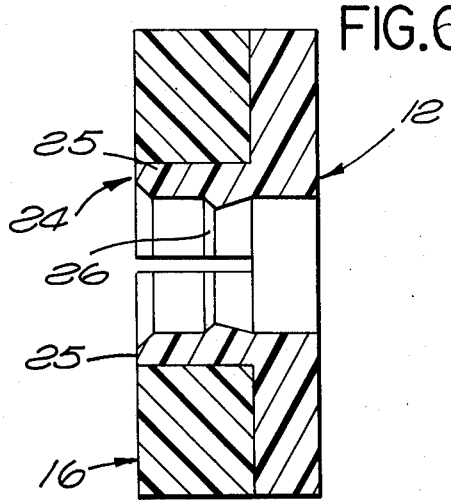
FIG.7.
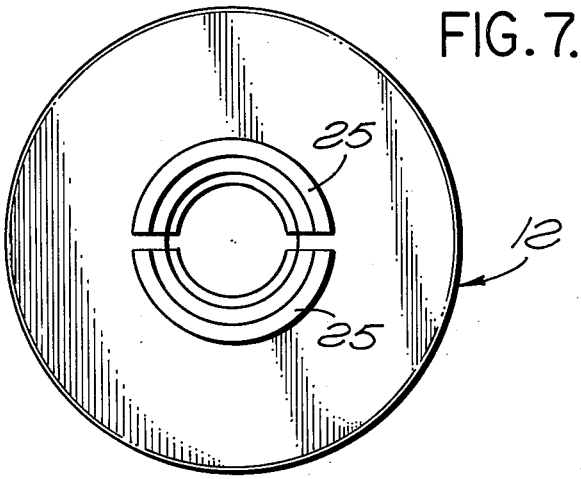
FIG.8.
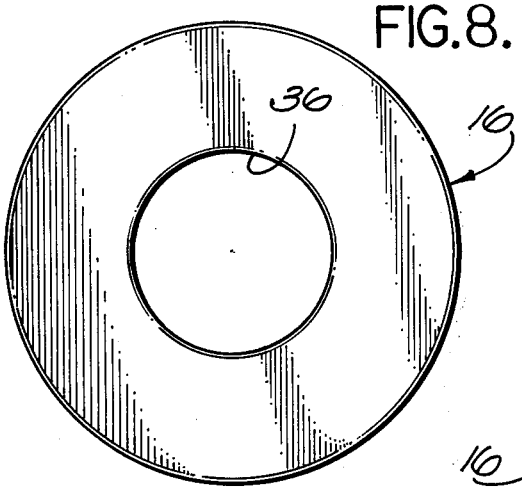
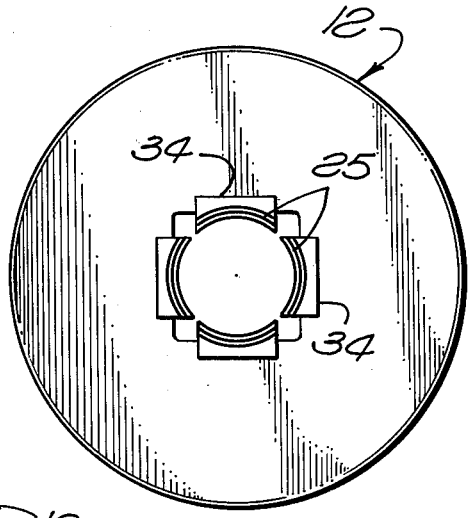
FIG.10.
FIG.9.
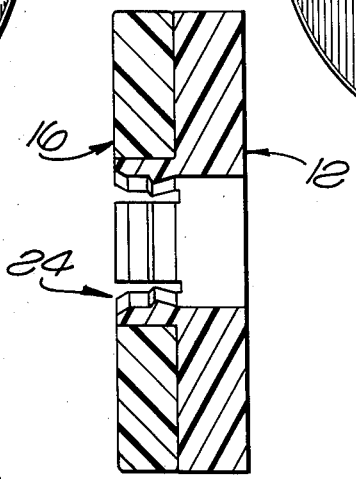
FIG.11.
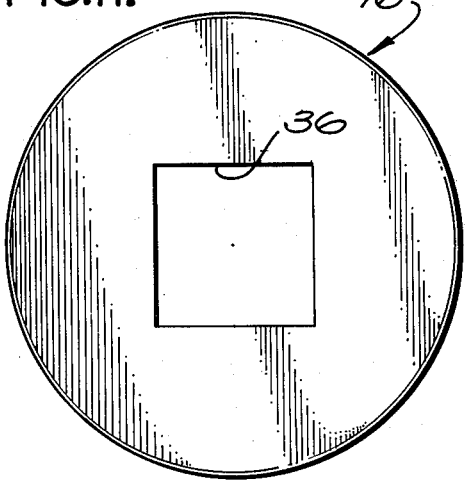
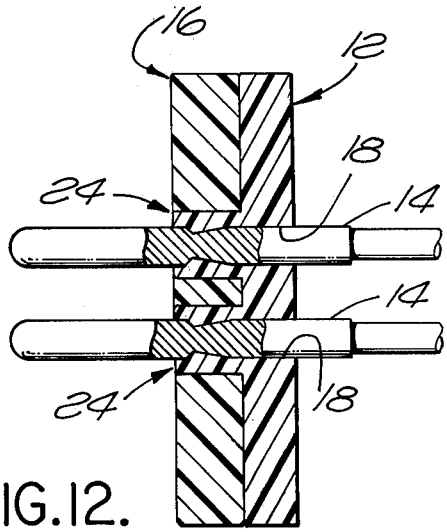
FIG.12.

CONTACT RETENTION ASSEMBLY

BACKGROUND OF THE INVENTION

The present invention relates generally to a contact retention assembly for an electrical connector and, more particularly, to a contact retention assembly embodying integral contact retention means.

The use of releasable electrical contacts in an electrical connector has rapidly increased due to the simplicity in replacing contacts in the field. Such replacement of contacts has obviated the necessity of replacing the entire connector assembly due to failure of a single contact. Both front and rear release retention systems have been utilized. A typical system utilizes a metal clip which is embedded in a plastic insulator for securing the contact in the connector assembly. Such an arrangement is shown in U.S. Pat. No. 3,158,424.

The disadvantages of metal clips in electrical connector assemblies are well known. A primary disadvantage is the large cost in molding or otherwise mounting the clip in the assembly. Further, in the metal clip retention arrangement, contact movement or splay may result from clip geometry and movement due to an inadequate mounting of the clip in the connector assembly. To overcome the disadvantage of metal clips in releasable contact connector assemblies, a plastic clip retention system has been used. Such arrangements are shown, for example, in U.S. Pat. Nos. 3,101,229; 3,165,369; and 3,638,165. The retention arrangements disclosed in these patents each embody a conical or cylindrical shaped retention member which surrounds the contact passage in an insulator. The contact is inserted into the passage from the rear of the insulator until the retention member snaps into a groove or behind a shoulder on the contact, limiting rearward movement of the contact in the passage. A shoulder is also required on the contact for engaging a rearwardly facing surface on the insulator to limit forward movement of the contact in the passage. An annular clearance space surrounds the retention member so that it will be free to be deflected radially outwardly when it is desired to remove the contact from the passage. This arrangement has the disadvantage, however, that the retention members are not supported sufficiently in the radial direction to provide as strong a retention force on the contacts as required for some applications. (Copending U.S. application Ser. No. 371,958, filed June 21, 1973, entitled, "Contact Retention Assembly," by M. J. McGhee, now) U.S. Pat. No. 3,824,523, discloses an integral contact retention arrangement in which the retention tines are surrounded by a rubber sealing grommet. This grommet, however, remains permanently in place and the contacts are inserted into and withdrawn through passages in the grommet. The retention tines are deflected radially outwardly by a special tool. The grommet deforms to accommodate this outward deflection of the tines. The grommet therefore does not provide any rigid support for the tines which would enhance the retention force on the contact.

It is the object of the present invention to provide an improved contact retention assembly having higher retention forces. It is also another feature of the invention to provide a contact retention assembly which does not require a separate shoulder on the contact to limit forward movement of the contact in the retention disc. Also, the invention permits the use of a wide variety of materials for the retention disc which is not possible with prior art integral contact retention assemblies wherein material specifications are typically very stringent.

SUMMARY OF THE INVENTION

According to the principal aspect of the invention, there is provided a contact retention assembly for an electrical connector comprising a retention disc having a contact mounted in a passage extending therethrough. Radially resilient retention means is integrally formed on the disc and extends forwardly from the front face thereof about the contact passage. The retention means is formed with an inwardly extending rib which engages within a groove in the contact to limit axial movement of the contact in the passage. A relatively rigid support collar is slid over the retention means. The collar firmly engages the outer surface of the retention means to restrain the latter against radially outward movement thereby securely locking the contact within the passage. By this arrangement a separate shoulder is not required on the contact for limiting movement of the contact in the forward direction in the retention disc. The contact may be removed rearwardly from the disc by first removing the support collar from the front of the disc. Normally a tool is utilized to spread the retention means outwardly allowing the contact to be freely removed from the rear of the disc. Thus, by use of the support collar of the present invention, the contact is securely retained against axial loading in either direction within the contact passage, and without the aid of a contact shoulder.

BRIEF DESCRIPTION OF THE DRAWINGS

FIG. 6 is a longitudinal sectional view through a second form of the contact retention assembly of the present invention, without a contact therein;

FIG. 7 is a front plan view of the retention disc utilized in the assembly illustrated in FIG. 6;

FIG. 8 is a front plan view of the support collar utilized in the assembly illustrated in FIG. 6;

FIG. 9 is a longitudinal sectional view through a third form of the contact retention assembly of the present invention, without a contact therein;

FIG. 10 is a front plan view of the retention disc utilized in the assembly illustrated in FIG. 9;

FIG. 11 is a front plan view of the support collar utilized in the retention assembly illustrated in FIG. 9; and FIG. 12 is a longitudinal sectional view through a further embodiment of the retention assembly of the present invention incorporating a plurality of contacts.

DESCRIPTION OF THE PREFERRED EMBODIMENTS

Figure 2:
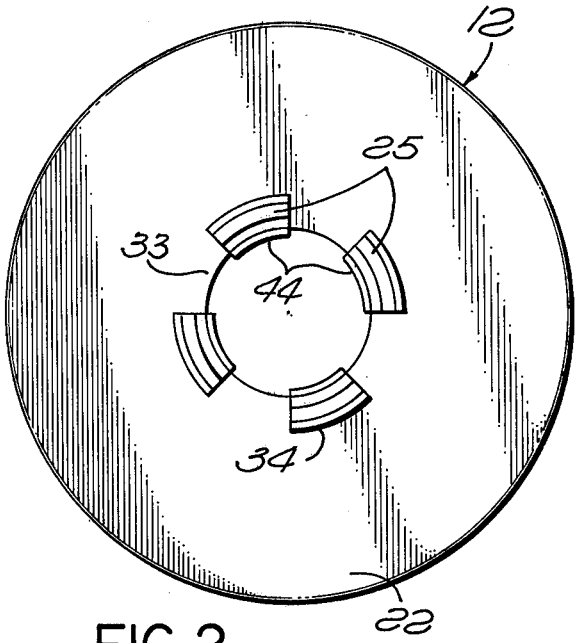
FIG. 2 is a front plan view of the retention disc utilized in the assembly illustrated in FIG. 1.
Figure 1:
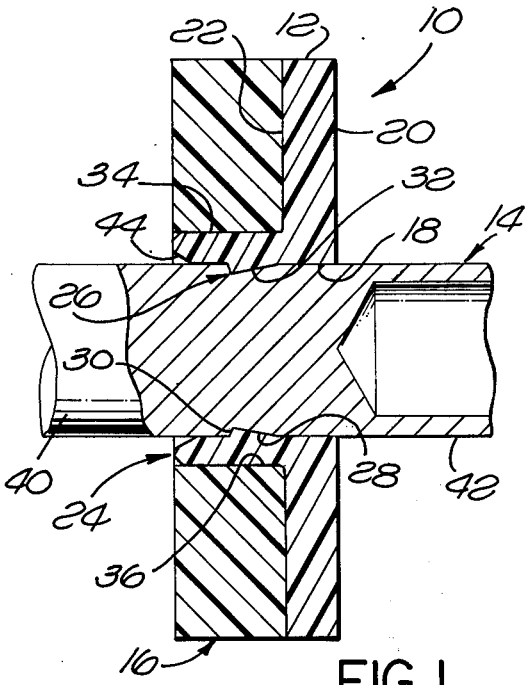
FIG. 1 is a longitudinal sectional view through one form of the contact retention assembly of the present invention.
Figure 3:
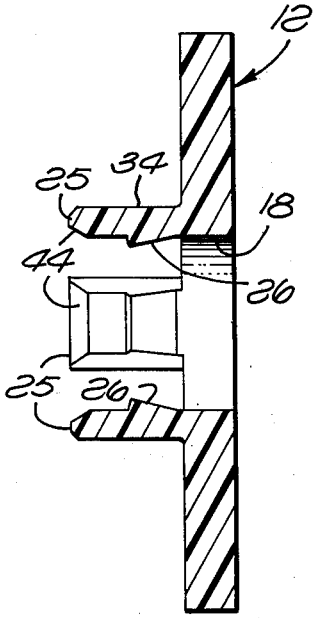
FIG. 3 is a longitudinal sectional view through the retention disc illustrated in FIG. 1.

Referring now to the drawings in detail, wherein like reference characters designated like or corresponding parts throughout the various views, there is illustrated in FIGS. 1–5 one embodiment of the contact retention assembly of the present invention, generally designated 10. The assembly 10 comprises a retention disc 12, a contact 14, and a support collar 16. The disc 12 is in the form of a flat circular insulator having a passage 18 extending from the rear face 20 to the front face 22 thereof. The contact 14 is mounted in the passage 18. Radially resilient contact retention means 24 is integrally formed on the disc 12 adjacent to the passage 18. Typically, the retention means comprises a plurality of radially resilient spaced fingers which extend forwardly from the front face 22 of the disc 12 around the passage. The fingers are formed with inwardly extending ribs 26 which engage in an annular groove 28 formed in the outer surface of the contact 14. Each rib 26 has a forwardly facing angular shoulder 30 and a rearwardly facing gradually inclined ramp 32. The groove 28 in the contact has a configuration complementary to that of the ribs 26.

In the embodiment of the invention illustrated in FIGS. 1–5, the retention means 24 includes four separate retention fingers 25. As seen in FIG. 2, each finger has a segmental configuration extending over an arc of about 45°. Adjacent fingers are separated from each other by a 45° clearance space 33. Obviously, a larger or fewer number of the retention fingers 25 may be employed. It is noted that the outer surface 34 of the fingers 25 define a cylinder.

The support collar 16 is a relatively flat circular insulator having a central cylindrical opening 36 therein which is slightly larger than the diameter of the outer surface 34 of the fingers 25. This collar is slid over the retention fingers after the contact 14 is mounted in the passage 18. The collar is formed of a relatively rigid material, which may be the same material from which the retention disc 12 is formed. In any event, the collar should be at least as rigid as the material of the disc 12. The support collar 16 embraces the retention means 24 to provide a rigid support for the retention fingers restraining them against radial outward movement.

The retention disc 12 and support collar 16 may be formed from any suitable molded, tough plastic material, such as any of the materials disclosed in the aforementioned U.S. Pat. No. 3,165,369. The relatively rigid support collar 16 is to be distinguished from a rubber grommet, for example, which performs only a sealing function and is incapable of providing any rigid support which would limit radial movement of the retention fingers.

Figure 4:
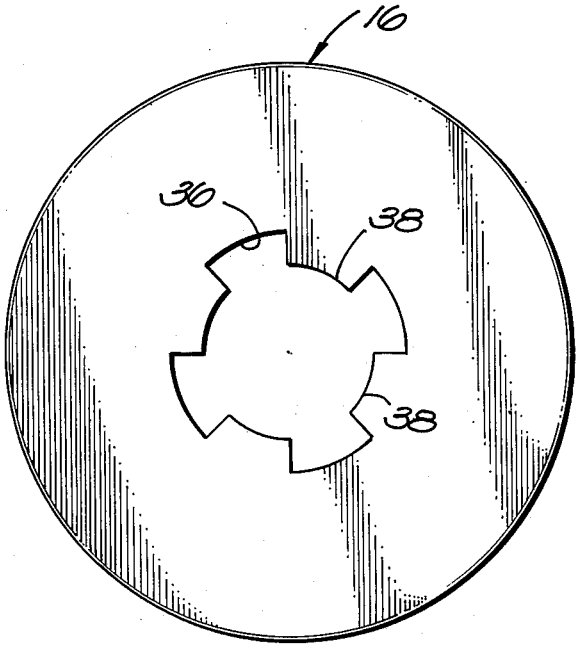
FIG. 4 is a front plan view of the support collar utilized in the assembly illustrated in FIG. 1.
Figure 5:
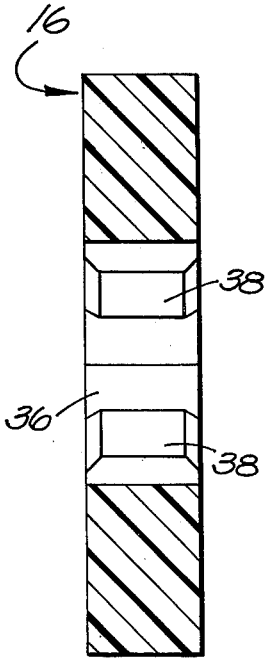
FIG. 5 is a longitudinal sectional view through the collar illustrated in FIG. 4.

As seen in FIGS. 4 and 5, the support collar is provided with spaced inwardly extending ridge members 38 which are equal in number to the retention fingers 25 and are dimensioned to fit into the spaces 33 between the fingers when the collar 16 is mounted onto the retention disc 12 over the retention fingers. Thus, the ridge members 38 interleave between the fingers 25 and will engage the outer surface of the contact 14.

The contact 14 has a forward contact engaging end 40 which may be in the form of either a pin contact or receptacle. The contact also has a rear wire termination end 42 which may be in the form of a solder pot, as shown, or a crimp barrel. There is no requirement for a collar on the contact providing a forwardly facing shoulder for engaging the rear face 20 of the retention disc 12 to limit forward movement of the contact relative to the disc due to the use of the support collar 16.

The contact is first inserted into the passage 18 in the disc 12 from the rear with the support collar 16 removed from the disc. The contact is moved forwardly in the passage deflecting the retention fingers 25 radially outwardly. Once the groove 28 in the contact becomes aligned with the ribs 26 on the retention fingers, the ribs will snap into the groove retaining the contact in the passage. At this point the contact will withstand considerable axial loading in the removal direction, that is, the rearward direction due to the cooperation between the forwardly facing shoulder 30 on the retention fingers and the corresponding surface on the groove 28. Axial loading in the insertion direction, however, is somewhat limited due to possible deflection of the retention fingers because no shoulder is provided on the contact. The support collar 16 is now assembled from the front over the contact retention fingers 25 restricting the fingers from any radially outward movement and thereby locking the ribs 26 of the fingers into the groove 28 on the contact. Now the contact is securely retained against axial loading in either direction without the aid of a contact shoulder.

Removal of the contact is achieved by first removing the support collar 16 from the disc 12. Thereafter the retention fingers 25 are deflected radially outwardly by the use of a suitable hollow extraction tool (not shown) which is inserted over the forward end 40 of the contact. The end of the tool engages a chamfered lead surface 44 formed on the forward ends of the retention fingers allowing the tool to slide under the fingers and deflect them away outwardly so that the ribs 26 are lifted out of the groove 28. Then the contact 14 may be removed rearwardly from the passage 18. Alternatively, if the angle on the forwardly facing shoulder 30 of the ribs 26 is sufficiently great and the retention fingers are sufficiently resilient, it is possible for the contact 14 to be removed from the passage 18 by simply pulling rearwardly on the contact forcing the retention fingers outwardly.

The number and form of the retention fingers and the form of the opening in the support collar may be varied to achieve an optimum deflection/bending stress relationship, depending upon the particular requirements being encountered. For example, as seen in the embodiment illustrated in FIGS. 6–8, the retention means 24 on the disc 12 may comprise a longitudinally split cylindrical member providing two retention members 25 of generally semicircular configuration. In this arrangement, the opening 36 in the support collar 16 is cylindrical, and does not embody any inwardly extending ridge members as does the support collar illustrated in FIGS. 4 and 5. It is also possible, by a proper selection of the material for the disc 12, to employ a retention cylinder 24 which is unslotted assuming that it is sufficiently resilient to allow the contact to be passed therethrough and to contract to cause the inwardly extending rib 26, which in this case would be a continuous ring, to engage within the groove 28 in the contact 14 (not illustrated in FIG. 6).

FIGS. 9–11 show still a further form of the contact retention assembly of the present invention. In this embodiment, the contact retention means 24 comprises four retention fingers 25 each having a flat outer surface 34. The fingers 25 are arranged in opposing pairs defining a generally square outer configuration. The opening 36 in the support collar 16 is square and dimensioned to fit over the fingers 25 with the sides of the opening slidably engaging the outer flat surfaces 34 of the retention fingers.

FIG. 12 illustrates the contact retention assembly of the present invention containing a plurality of contacts 14. The contacts extend through passages 18 in the retention disc 12. The disc embodies a plurality of retention means 24 each cooperating with a separate one of the contacts. The configuration of the disc 12 and collar 16 may take the form of any of the various embodiments disclosed herein. It is noted that the contacts 14 are illustrated in FIG. 12 as being pin-type contacts. If the contacts were receptacle type contacts, preferably an additional insulator would be mounted in front of the support collar 16 to embrace the receptacle portions of the contacts in a manner well known in the art.

Normally a connector embodying the retention assembly of the present invention will incorporate a plurality of contacts, for example, three to five contacts. Obviously, a larger number of contacts could be used, if desired.

From the foregoing, it will be appreciated that the present invention provides higher retention forces for contacts than has been possible heretofore with prior art integral retention methods. The invention also has the advantage that when the support collar 16 is in position of the disc 12, the retention fingers cannot be damaged by an unskilled repairman attempting to remove the contacts with an extraction tool or other object. The support collar also provides increased stability under contact bending loads. Also, the collar provides an almost complete plastic dielectric around the contacts, since it minimizes any air gaps which are normally found in integral plastic retention assemblies. This arrangement also restricts the ingress of any foreign material which could foul the retention assembly or damage the locking surfaces. The use of the separate support collar also allows considerable variation in the materials utilized in forming the retention disc 12. For example, the disc 12 need not be made from as resilient a material as do those in the prior art assemblies not having a support collar. Conversely a more resilient retention disc material may be used in conjunction with a rigid support collar. An additional advantage of this invention over prior art assemblies is the ability to assemble, test and stock retained contact assemblies in or out of connector shells. Finally, the invention is particularly useful for low density circular or rectangular connectors involving high voltages and/or high mating or shock loads.

What is claimed is:

1. A rear insertion front release electrical connector contact retention assembly comprising:

an insulator having a passage therethough from a front face to a rear face thereof;

a contact having a forward contact engaging end, a rear termination end for connection to a wire and an annular groove between said ends, said contact being mounted in said passage with said contact engaging end and groove forward of said front face;

radially resilient contact retention means integral with said insulator extending forwardly from said front face adjacent to said passage, said retention means having an outer surface and a rib on the inner surface thereof engaged with said groove to limit axial movement of said contact in said passage in opposite directions;

a relatively rigid support collar having an opening therein slidably receiving said retention means, the wall of said opening firmly engaging said outer surface of said retention means at least in the region surrounding said rib to provide a rigid support therefor restraining said retention means against radially outward movement thereof; and said collar being slidably removable in the forward direction from said retention means allowing said contact to be removed rearwardly from said passage; said retention means comprises a plurality of spaced fingers; and the wall of said opening in said collar embodies a plurality of spaced inwardly extending ridge members interleaved between said spaced fingers.

* * * * *